US005598955A

United States Patent [19]

Reilley

[11] Patent Number: 5,598,955

[45] Date of Patent: Feb. 4, 1997

[54] GASOLINE DISPENSING CONTAINER WITH SAFETY FEATURE

[76] Inventor: Peter Reilley, 20 King Arthur Dr., Londonderry, N.H. 03053

[21] Appl. No.: 503,866

[22] Filed: Jul. 18, 1995

[51] Int. Cl.[6] ..... B65D 37/00

[52] U.S. Cl. ..... 222/209; 222/212; 222/529

[58] Field of Search ..... 222/211, 212, 222/529, 543, 463, 465.1, 209

[56] References Cited

U.S. PATENT DOCUMENTS

| | | | |
|---|---|---|---|
| 125,813 | 4/1872 | Hauck | 222/463 X |
| 3,184,107 | 5/1965 | Kohanzo | 222/543 X |
| 3,783,888 | 1/1974 | Johnson . | |
| 4,310,013 | 1/1982 | McClaskey . | |
| 4,592,492 | 6/1986 | Tidmore | 222/212 X |
| 4,834,269 | 5/1989 | Cone | 222/465.1 |
| 5,234,016 | 8/1993 | Winn . | |
| 5,472,124 | 12/1995 | Martushev | 222/529 |

*Primary Examiner*—Gregory L. Huson
*Attorney, Agent, or Firm*—Iandiorio & Teska

[57] ABSTRACT

A container for safely dispensing or drawing in volatile fluids such as gasoline. The device includes a flexible siphon hose for filling other containers or drawing in fluid from other containers. The fluid flow is controlled by the pressure applied to a flexible surface of the container. In the normal storage position the container cannot leak fluid out of the siphon.

20 Claims, 4 Drawing Sheets

GASOLINE DISPENSING CONTAINER WITH SAFETY FEATURE

BACKGROUND, FIELD OF INVENTION

This invention relates to the storage and dispensing of fluids.

BACKGROUND, DESCRIPTION OF PRIOR ART

The current method for storing and dispensing fluids is a container with a screw cap and a spout or a funnel for pouring the fluid into another container. This system is cumbersome and prone to spills. It is dangerous when dispensing hazardous fluids such as gasoline.

There are hand pumps available but they are either expensive or not reliable. The mechanical pump disclosed by Winn in U.S. Pat. No. 5,234,016 is complicated would be expensive to produce. Some pumps depend on lung pressure which pose a health hazard. Such devices are disclosed by McClaskey in U.S. Pat. No. 4,310,013 and Johnson in U.S. Pat. No. 3,783,888.

Generally these pumps are not integral to the fluid container. Using them requires opening the container and inserting the pump. When done, the pump must be removed and stored. The entire process has many opportunities for leaks and spills.

Another system for dispensing fluids is the well known laboratory wash bottle. This is a flexible plastic bottle with a siphon tube. When the bottle is squeezed the fluid comes out the siphon tube. This works well for fluids with low vapor pressure such as water. A fluid with high vapor pressure would continuously leak out the siphon tube due to the pressure build-up in the container.

BRIEF DESCRIPTION OF DRAWINGS

FIG. 3 shows container 10 in the position for drawing fluid in. If pressure is applied to container 10 on surface 23, air will be expelled out of siphon tube 13. When the pressure is released the vacuum generated will draw the fluid in.

REFERENCE NUMERALS IN DRAWINGS

Figure 1:
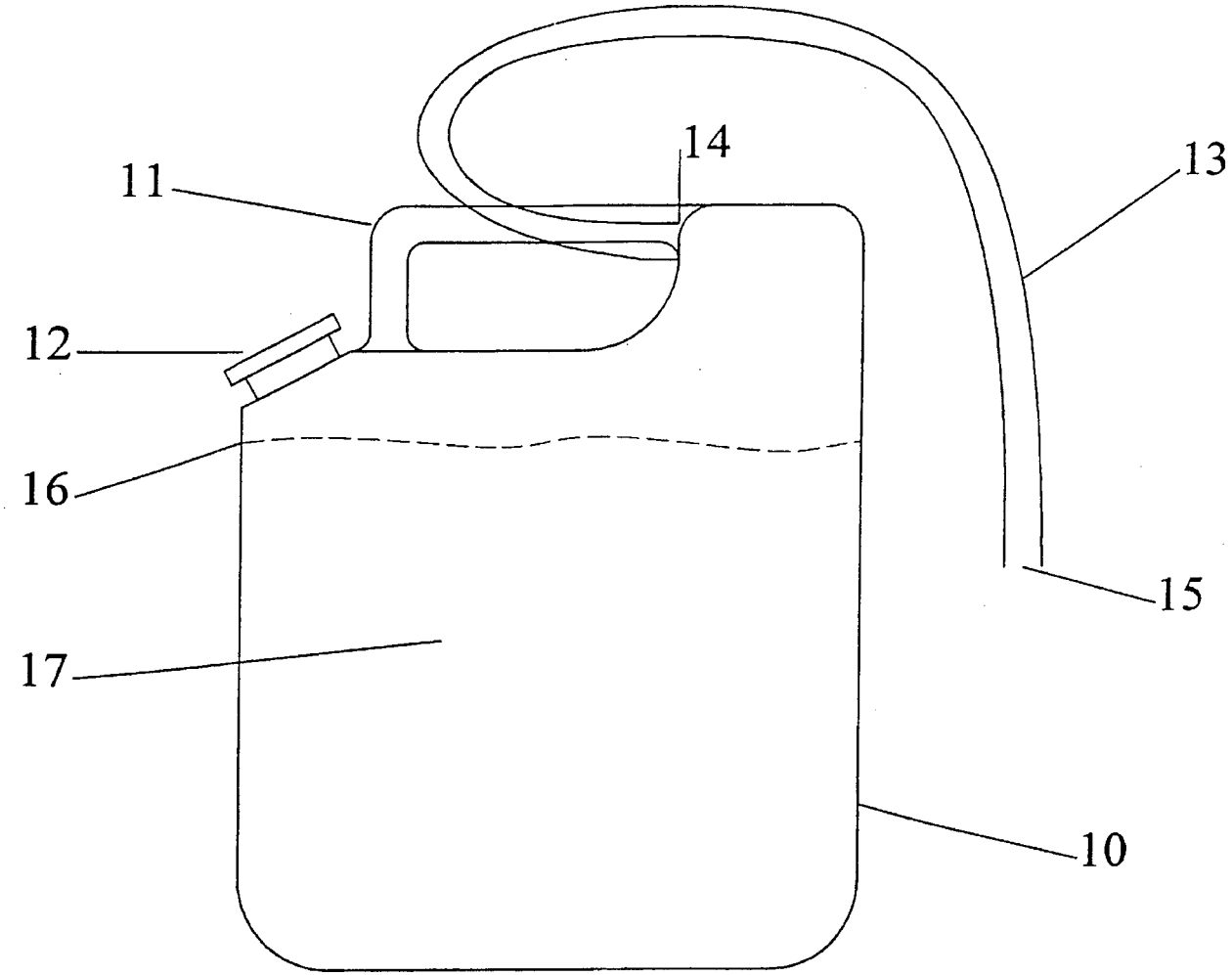
FIG. 1 shows a container 10 in the normal storage position. In this position the fluid cannot leak out of a siphon tube 13 because tube entry point 14 is above fluid level 16.

10 container
11 handle
12 container filler cap
13 tube
14 attachment point of tube to container
15 dispensing end of tube
16 fluid level
17 side of container
18 folds to aid the flexibility of the container
19 cup holding fluid to be drawn in

20 cap to close the end of the tube
21 valve to close the tube
22 strap to keep the cap from becoming lost
23 other side of the container

DESCRIPTION OF THE INVENTION

The convenience of the wash bottle can be combined with the safety required for storing hazardous fluids. I will use the example of gasoline as a hazardous fluid but the invention applies to any fluid, hazardous or not.

The drawing in FIG. 1 shows the preferred embodiment of the invention. Container 10 is similar to standard gasoline containers including handle 11 and filling cap 12. The invention involves flexible dispensing tube 13, attachment point 14 and tube opening 15. The invention specifies that the tube attachment point 14 be above the highest gasoline level 16 when the container is in the storage position as shown in FIG. 1. In this position if the tube were to leak due to vapor pressure buildup only the vapor would escape and not the fluid.

Figure 2:
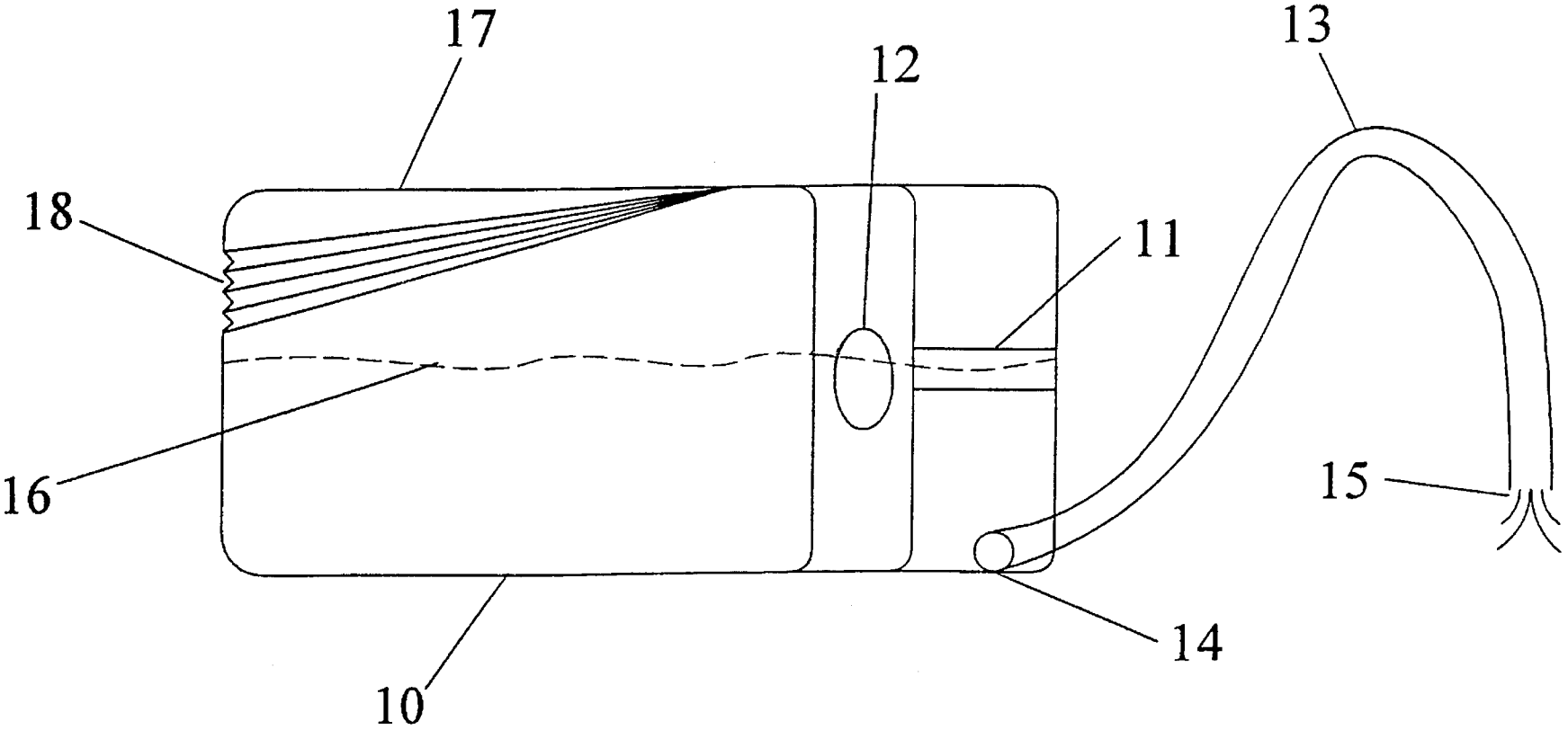
FIG. 2 shows container 10 in the dispensing position. Siphon tube entry point 14 is below fluid level 16 such that if pressure is applied to container 10 on surface 17 then the fluid would be forced out of siphon tube 13.

When container 10 is in the dispensing position as shown in FIG. 2 the attachment point 14 is near the bottom of the gasoline level. When pressure is applied to side 17 the gasoline will flow through tube 13 and out opening 15. The accordion like folds 18 aid in the flexibility of the container. Removing the pressure will stop the gasoline flow. If there is not enough movement possible in pressing the flexible side 17 to get the desired quantity of gasoline, releasing the pressure will cause the container to expand and draw air into the container through tube 13 until the container has fully expanded. Re-applying the pressure at 17 will then expel another volume of gasoline. In this way the container will act as a gasoline pump. The gasoline can be dispensed until it is empty by repeating the procedure.

Figure 3:
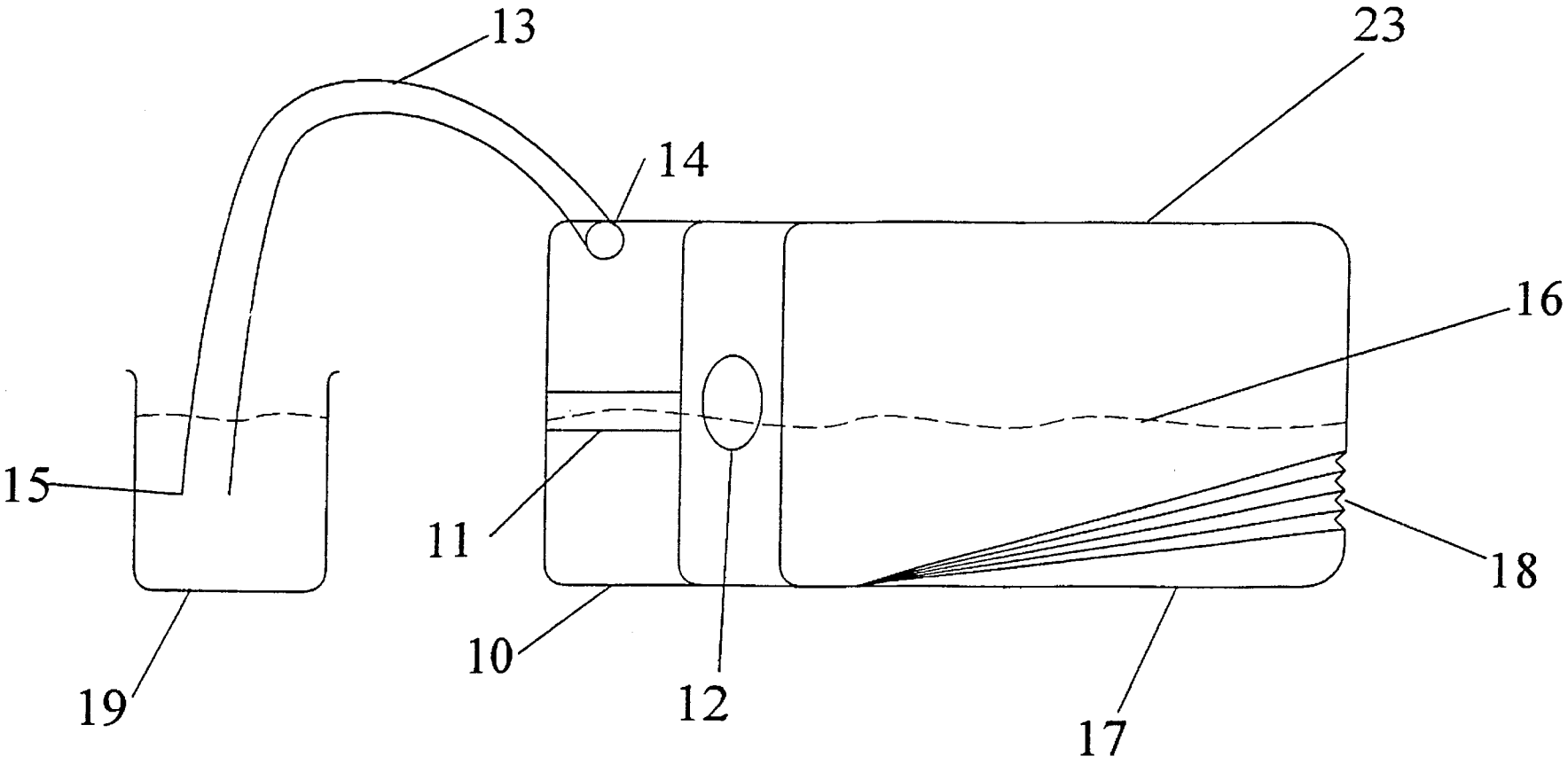

Container 10 can be used to draw in gasoline from another container 19. This is accomplished by turning container 10 over onto it's other side such that the tube attachment point 14 is above the fluid level 16 as shown in FIG. 3. Place the tube end 15 into the fluid to be drawn in and press side 23 to expel air. When the pressure on side 23 is released the vacuum caused by expanding container 10 will draw the fluid in.

Figure 5:
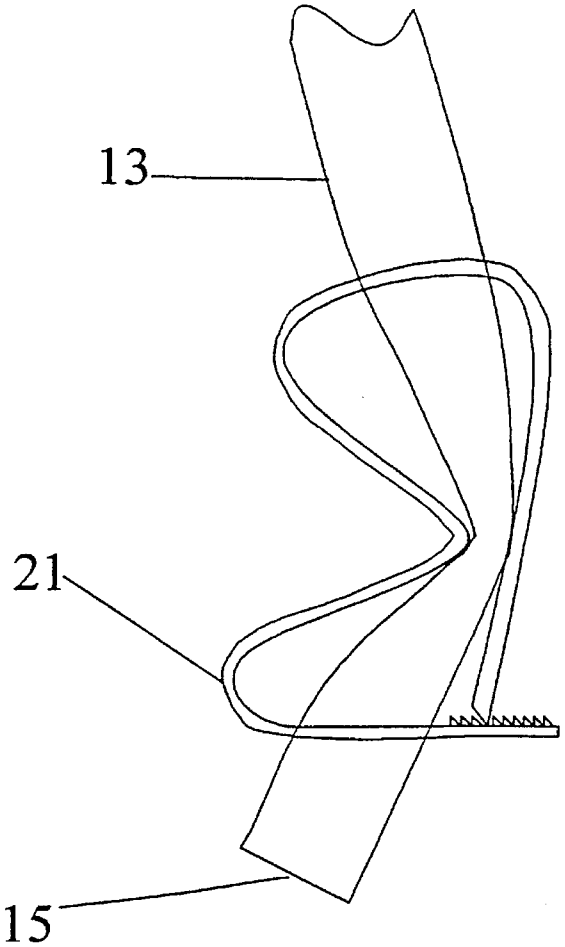
FIG. 5 shows a valve 21 that can be used to close siphon tube 13.
Figure 4:
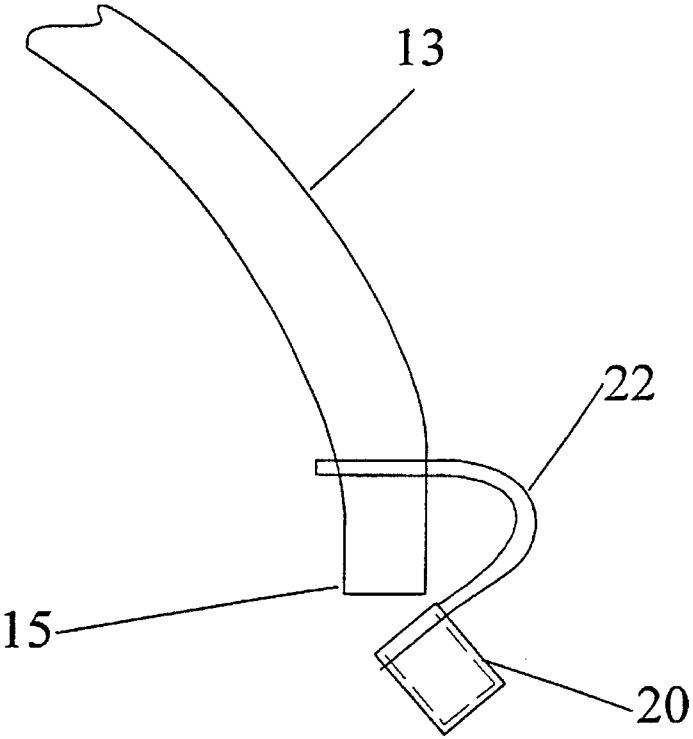
FIG. 4 shows a cap 20 that is able to cover the end of siphon tube 13.

The end of tube 13 should have some means of being closed when the container is stored. FIG. 4 shows a cap 20 that can be pressed over open end 15 of tube 13. There is a retaining a strap 22 to prevent cap 20 from getting lost when container 10 is in use. An alternate method is to provide a valve 21 that can close tube 13 when it is not in use. FIG. 5 shows a compression valve 21 that can squeeze tube 13 until it is closed. There is a wide variety of valve designs that are satisfactory for this purpose.

I claim:

1. A liquid container system comprising:

a container which is capable of being set in a storage position and in a different, dispensing position;

a first port in said container which is situated above a liquid level within said container when said container is in said storage position;

a discrete second port which is situated a greater distance from said liquid level than said first port when said container is in said storage position, and which is situated below said liquid level when said container is in said dispensing position; and a pumping device integral with said container for producing a positive pressure in said container when said container is in said dispensing position.

2. The liquid container system of claim 1 further comprising a tube coupled to said second port and extending outwardly from said second port.

3. The liquid container system of claim 2, further comprising means for sealing said tube to eliminate spillage from said tube.

4. The liquid container system of claim 3 wherein said means for sealing comprises a valve.

5. The liquid container system of claim 3 wherein said means for sealing comprises a cap.

6. The liquid container system of claim 1 in which said container is also capable of being set in an intake position, wherein said second port is situated above said liquid level when said container is in said intake position and wherein said pumping device produces a negative pressure within said container for drawing liquid through said second port into said container.

7. The liquid container system of claim 6 wherein when said container is in said dispensing position, said pump is directly accessible.

8. The liquid container system of claim 6 wherein when said container is in said intake position, said pump is indirectly accessible.

9. A liquid container system comprising:

a container which is capable of being set in at least three different positions, a first position for storage, a second position for dispensing liquid and a third position for intaking liquid;

a first port in said container which is situated above a liquid level within said container when said container is in said first position;

a second port in said container which is situated above the liquid level when said container is in said first position and said third position and below the liquid level when said container is in said second position.

10. The liquid container system of claim 9 further comprising means for driving liquid out of said container through said second port when said container is in said second position and for drawing liquid into said container through said second port when said container is in said third position.

11. The liquid container system of claim 9 further comprising a tube coupled to and extending outwardly from said second port.

12. The liquid container system of claim 11 further comprising means for sealing said tube to eliminate spillage from said tube.

13. The liquid container system of claim 12 wherein said means for sealing comprises a valve.

14. The liquid container system of claim 12 wherein said means for sealing comprises a cap.

15. The liquid container system of claim 10 wherein said means for driving comprises a pumping device integral with said container.

16. The liquid container system of claim 15 wherein said pumping device is directly accessible in the second position.

17. The liquid container system of claim 10 wherein when said container is in the third position, the pumping device is indirectly accessible.

18. A liquid storage container system comprising:

a storage container having a storage position and a dispensing position;

a port in said container above a liquid level in said storage position to prevent leakage of liquid due to vapor pressure and below the liquid level in said dispensing position;

a tube having one end connected with said port and the other distal end extending from said container; and a pumping device integral with said container for producing a positive pressure in said container in said dispensing position to drive liquid from said container.

19. The liquid storage container system of claim 18 in which said container has a third fill position in which said port is below said liquid level and said pumping device produces a negative pressure to draw liquid in to fill said container.

20. The liquid storage container system of claim 18 in which said pumping device is on a side wall of said container.

* * * * *